US008686294B2

(12) United States Patent
Clayton et al.

(10) Patent No.: US 8,686,294 B2
(45) Date of Patent: Apr. 1, 2014

(54) ELECTRICAL INSULATING CAP FORMATION

(75) Inventors: Patrick Clayton, Worthing (GB); Patrick Hester, Pullborough (GB)

(73) Assignee: Lamina Dielectrics Limited, Billingshurst (GB)

( * ) Notice: Subject to any disclaimer, the term of this patent is extended or adjusted under 35 U.S.C. 154(b) by 79 days.

(21) Appl. No.: 13/391,280

(22) PCT Filed: Aug. 20, 2010

(86) PCT No.: PCT/GB2010/001583

§ 371 (c)(1), (2), (4) Date: Feb. 17, 2012

(87) PCT Pub. No.: WO2011/021011

PCT Pub. Date: Feb. 24, 2011

(65) Prior Publication Data

US 2012/0145435 A1 Jun. 14, 2012

(30) Foreign Application Priority Data

Aug. 21, 2009 (GB) ..... 0914699.4

(51) Int. Cl.
*H01B 17/00* (2006.01)

(52) U.S. Cl.
USPC ..... 174/148; 174/149 R; 174/137 R; 174/188

(58) Field of Classification Search
USPC ..... 174/148, 135, 137 R, 145, 149 R, 152 R, 174/152 G, 77 R, 84 R, 71 R, 72 R, 72 A, 188, 174/176, 138 F, 76; 16/2.1, 2.2; 248/68.1, 248/49, 65, 73
See application file for complete search history.

(56) References Cited

U.S. PATENT DOCUMENTS

| | | | | |
|---|---|---|---|---|
| 2,701,273 | A * | 2/1955 | Badeau | 174/138 F |
| 3,829,635 | A * | 8/1974 | Elwert et al. | 174/138 F |
| 3,868,475 | A | 2/1975 | Allison | |
| 3,899,807 | A | 8/1975 | Sovish et al. | |
| 4,074,065 | A | 2/1978 | Leaf et al. | |
| 4,435,615 | A * | 3/1984 | Kaczerginski et al. | 174/189 |
| 4,654,539 | A | 3/1987 | Moller | |
| 5,954,539 | A | 9/1999 | Hornung | |
| 7,074,077 | B2 * | 7/2006 | Sakaguchi et al. | 174/76 |
| 7,663,059 | B2 * | 2/2010 | Daitou | 174/77 R |

FOREIGN PATENT DOCUMENTS

| | | |
|---|---|---|
| GB | 1140457 | 1/1969 |
| GB | 1 334 556 | 10/1973 |
| GB | 2 084 505 | 4/1982 |
| JP | 10 304537 | 11/1998 |
| WO | WO 2008/142159 | 11/2008 |

* cited by examiner

*Primary Examiner* — Angel R Estrada
(74) *Attorney, Agent, or Firm* — Levy & Grandinetti

(57) ABSTRACT

An electrical insulating cap formation is disclosed. The electrical insulating cap formation includes a strip of material and a plurality of electrical insulating caps carried thereon in a row, in which intervals are provided between each, or groups of two or more, of the electrical insulating caps.

17 Claims, 4 Drawing Sheets

ELECTRICAL INSULATING CAP FORMATION

This application is the U.S. National Phase of International Application Number PCT/GB2010/001583 filed on Aug. 20, 2010, which claims priority to Great Britain Application Number 0914699.4 filed on Aug. 21, 2009.

This invention relates to an electrical insulation cap formation for use particularly, but not exclusively, in manufacturing groups of three heat shrinkable electrical insulating caps for use in electrical motors.

It is known to provide heat shrinkable insulating caps for insulating electrical components, such as crimped connections to magnet wires within electric motors, or thermal switches used within motor windings.

Such caps are made from tubes which are wound from a combination of different polymeric films provided in strips. The formed tubes are cut into small pieces, before one end is closed by flattening an end of the tube and welding it together, or heat forming it into that shape.

With this construction the caps have electrical and mechanical properties which are difficult to produce by other means. For example, by forming the tubes from different films the resulting caps can have a modified polyamide interior layer and a heat shrinkable polyester outer layer. As such a high temperature heat shrinkable modified polyamide cap can be produced, which is also capable of absorbing insulation varnishes during the manufacture of an electric motor, and hence has high dielectric strength at high temperatures.

However, this manufacturing method results in separate caps, which are difficult to handle in the large numbers which are often used in manufacturing. In particular, each cap has to either be fitted manually to a crimped connection, which is time consuming, involves high labour costs, and can result in repetitive strain injuries, or the caps have to be fed into an automatic assembly machine using a vibratory bowl feeder or the like to orientate them correctly, which adds cost and complexity.

It is known to provide a formation of electrical or mechanical components arranged in rows and in a particular orientation, which can be fed into a manufacturing process. Such formations can be formed by connecting the components to one another, or by affixing them to a carrier component such as a strip of material. For example, GB1140457 in the name of Associated Electrical Industries Limited, shows apparatus comprising strips of material with electronic components mounted in a particular orientation thereon using an adhesive, which are delivered continuously into an automatic placement machine for mounting them on printed circuit assemblies. Another example is shown in WO2008142159 in the name of Rennsteig Werkzeuge GmbH, in which a row of metal crimp connectors are formed in a strip, and are fed into a machine which automatically separates them from the strip for further use.

However, it is not possible to readily affix the above described types of electrical insulating caps to a strip of material in any of the known ways, nor is it possible to manufacture them in a continuous row.

In particular, due to the form of the closure of the cap it would be difficult to reliably attach them to a strip of material using an adhesive. What is more, the known adhesives used to attach components to a strip are damaging to the environment and leave residues which are unacceptable in some motor applications, such as hermetic compressors. With regard to forming components in a row, this is only possible when the components are constructed form a homogeneous material, as is the case with metal crimp connectors. Caps constructed from wound tubes so they possess the above described desired properties cannot be formed in a row during their fabrication.

The present invention is intended to overcome some of the above problems.

Therefore, according to the present invention an electrical insulating cap formation comprises a strip of material and a plurality of electrical insulating caps carried thereon in a row, in which intervals are provided between each, or groups of two or more, of the electrical insulating caps.

The present invention provides solutions to a number of problems. In particular, the present invention includes a formation of electrical insulating caps which can be fed continuously into an assembly machine, which does away with the need for machinery to handle, orientate and feed separate parts into such an assembly machine.

In addition, the electrical insulating caps can be formed into particular separated groups on the strip of material, which groups may have a specific purpose when separated from the formation. For example, a row of three caps arranged in the same orientation can be used for insulating the three grouped crimped connections to magnet wires used in an electric motor. Currently such grouped connections of wires are manually fitted with electrical insulating caps separately, and the group is then inserted into the windings of the motor. The use of a single component comprising three such caps would significantly reduce construction time, labour costs and the occurrence of repetitive strain injuries. The formation of the invention could comprise a plurality of such three cap groupings, ready to be separated and used.

The intervals provided between each, or groups of two or more caps serve a number of purposes. Firstly, where the formation is to be fed into an automatic processing machine, the caps will need to be separated from the formation for use, and this will usually be achieved with a cutting tool. By leaving an interval between the caps this can provide sufficient space for the cutting tool to operate without damaging the caps. The same may be true when the formation is to be cut up manually.

The second reason for the interval is to allow for a section of the strip of material to perform an additional function along with a cap or group of caps separated from the formation. For example, where groups of three caps are used to insulate the crimped connections to magnet wires in an electric motor, a section of the strip of material in the interval can be retained on one or both sides of the group, and used as a barb or the like to assist in the insertion of the connected wires into the windings of the motor. Likewise, if individual caps are separated by intervals on a strip of material, when they are cut into separate pieces they can become a component comprising an end cap with tabs extending out of one or both sides, which may have a number of uses, as referred to above.

It will be appreciated that cutting of individual or groups of electrical insulating caps from the formation is something which can be performed by the manufacturer of the formation, to achieve end components for shipping, or the cutting can be performed by customers who purchase the formation.

The electrical insulating caps can be carried on the strip of material in any way. For example, they could be affixed to the strip of material at a midpoint thereof, or even adjacent their open ends. However, preferably the electrical insulating caps each can each comprise a tube with a closed end section comprising a flattened section of said tube welded together, and the end sections can be carried on the strip of material.

The electrical insulating caps can be arranged at any orientation to the strip of material as required, for example at 45 degrees thereto. However, in a preferred construction the electrical insulating caps can each comprise a lengthwise axis; the strip of material can comprise a lengthwise axis; and the electrical insulating caps can be carried on the strip of material with their lengthwise axes substantially normal to the lengthwise axis of the strip of material.

In a preferred construction the end sections of the electrical insulating caps can be welded to the strip of material. This can be achieved with an ultrasonic weld, or a heat activated weld.

In one construction the end sections can be welded to the strip of material with the same weld which forms the closed end section. This arrangement reduces the number of constructional steps.

Preferably the electrical insulating caps can be heat shrinkable. The invention includes heat shrinkable electrical insulating caps of any material, including simple moulded items made from a single body of insulating material for example rubber or any appropriate plastics material, but preferably the electrical insulating caps can be formed from wound polymeric films, like the advantageous type described above.

In one construction the strip of material can be provided with readable position markings at pre-determined positions in relation to the electrical insulating caps. Such readable position markings can be used by a machine to precisely locate the formation, and therefore one or more of the electrical insulating caps carried thereon, which may be of use during cutting of the formation as described above, or later during orientation of separated caps prior to, or during fitment to another item. The readable position markings can comprise any marking which could be machine readable, including indicia applied to the strip of material, or openings formed in the strip of material, either of which can be used with an optical reader. Alternatively the markings could be a physical shaping of the strip of material which could be read by a motion sensor or the like.

The strip of material could also be provided with score lines at pre-determined positions in relation to the electrical insulating caps, which could assist in the cutting or breaking apart of the formation.

Where a long formation of numerous individual or groups of electrical insulation caps is produced, it must be effectively packaged for transportation and storage. It would not be practical to form the formation into a roll, so in one construction the strip of material can comprise a plurality of folds substantially normal to its lengthwise axis, and each fold can be in the opposite direction to the last. As such, the formation can be folded up in a neat zigzag arrangement.

In another embodiment of the invention the formation can be provided with a barb feature which extends in the direction of the lengthwise extent of the caps. To facilitate this the strip of material can comprise a height, which is greater than the lengthwise extent of the end sections. As such, the strip of material can comprise a wing portion which extends over at least a part of tubular sections of the electrical insulating caps, and the strip of material can be formed such that an outer edge of said wing portion is spaced apart from said tubular sections of the electrical insulating caps.

This construction provides an effective barb for securing caps separated from the formation in the windings of an electric motor, as such separated caps can be pushed into the windings end section first, and once inside the wing portion can act to prevent the removal of the caps therefrom.

Preferably the formation can be provided with such a barb feature on both sides thereof, which further improves the ability of caps separated from the formation to be secured in position in the windings of an electrical motor. Therefore, the strip of material can be folded along a line substantially parallel to its lengthwise axis, and end sections of the electrical insulating caps can be disposed inside the strip of material with a first section of the strip of material extending over a first side of said end sections and a second section of the strip of material extending over a second side of said end sections.

The first and second sides of the strip of material can comprise a height which is greater than the lengthwise extent of the end sections. As such, the strip of material can comprise first and second wing portions which extend over at least a part of tubular sections of the electrical insulating caps on opposite sides thereof. The strip of material can be formed such that outer edges of the first and second wing portions are spaced apart from said tubular sections of the electrical insulating caps on opposite sides thereof.

The strip of material in this construction can be formed with folds which facilitate the spacing of the outer edges from the caps. Alternatively, the strip of material can simply be formed from a resilient material which adopts this position by virtue of being placed over the caps.

The invention can be performed in various ways, but six embodiments will now be described by way of example, and with reference to the accompanying drawings, in which FIG. 1 is a perspective view of an electrical insulating cap formation according to the present invention;

(In the following description like components in the six different embodiments of the present invention are given the same reference number.)

Figure 1:
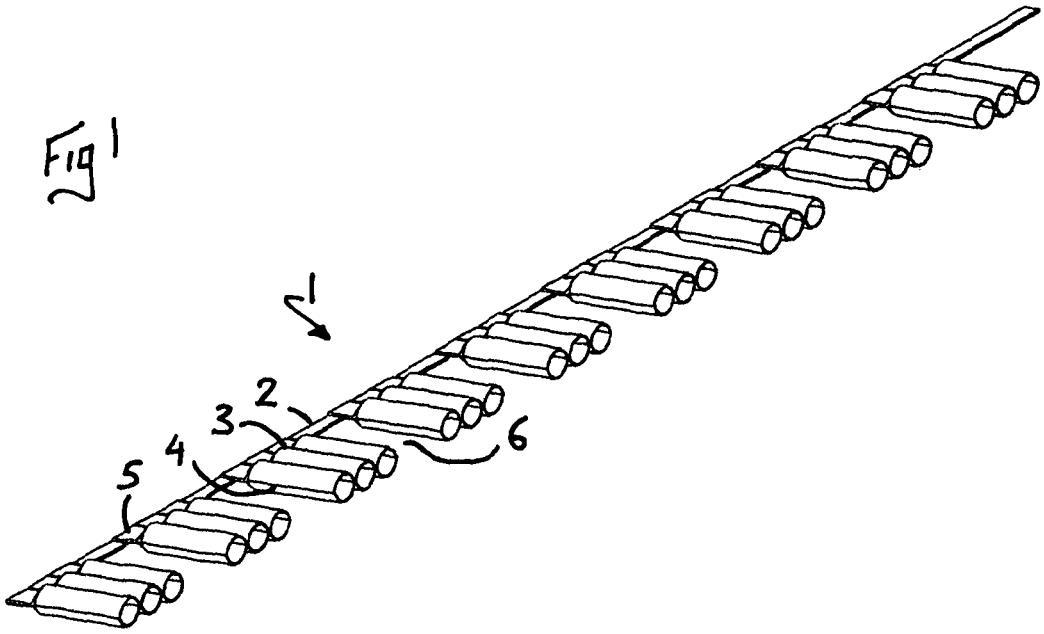

As shown in FIG. 1, an electrical insulating cap formation 1 comprises a strip of material 2 and a plurality of electrical insulating caps 3 carried thereon in a row, which in this case comprise a plurality of groups 4 of three heat shrinkable electrical insulating caps 3. Intervals 6 are provided between each group 4 of the caps 3.

Figure 2:
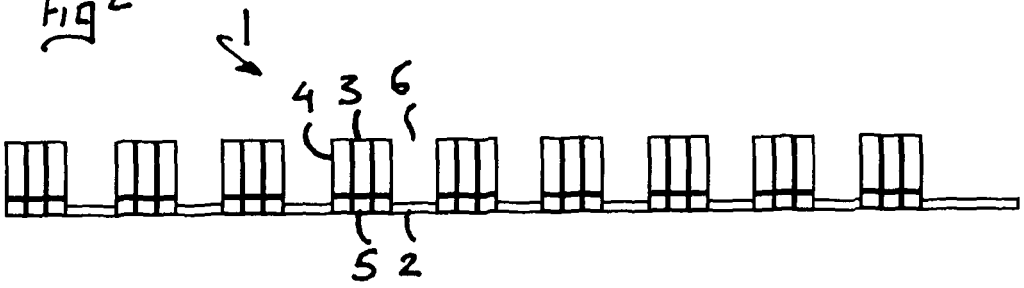
FIG. 2 is a side view of the electrical insulating cap formation as shown in FIG. 1.

The caps 3 are formed from different polymeric films wound into a tube, which is then cut into pieces. The caps 3 have a closed end section 5, which comprises a flattened section of said tube welded together. As is clear from FIGS. 1 and 2, the caps 3 are carried on the strip of material 2 by their end sections 5. The caps 3 comprise a lengthwise axis, and they are carried on the strip of material 2 normal to a lengthwise axis of the strip of material 2.

The strip of material 2 is constructed from a plastics material, and the caps are ultrasonically welded to it. The caps 3 are welded to the strip of material 2 with the same weld which is used to form the closed end sections 5.

The formation 1 is produced during an initial manufacturing stage, which includes the winding of the tube for the caps 3, its cutting into small pieces, and the simultaneous closure and mounting of those pieces on the strip 2 with ultrasonic welding. Formation 1 is a short piece shown for illustrative purposes, but in practice formations like this would be manufactured which measure in meters or tens of meters in length.

Such formations can be shipped in this configuration for a customer to deal with as they see fit. For example, these formations can be fed continuously into an automatic cutting and mounting machine, which cuts the strip of material 2 in the intervals 6, and then mounts the resulting separate three cap groups on waiting three wire crimped connections to magnet wires for use in an electrical motors. A machine can hold the formation 1 by the strip of material 2 during the feeding process, which ensures the caps 3 are not damaged.

Alternatively, the formation 1 can be cut either manually or automatically into the three cap groups, which can then be mounted manually to prepared three wire crimped connections to magnet wires for use in electrical motors.

In either case, the intervals 6 are of sufficient width to allow for the ready automatic or manual cutting of the strip of material 2 without causing any damage to the caps 3.

Figure 3:
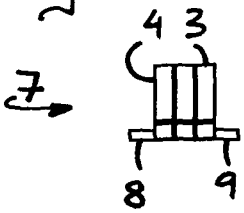
FIG. 3 is a side view of a first product of the electrical insulating cap formation as shown in FIG. 1.

The formation 1 can be cut into pieces in different ways. FIG. 3 shows a possible product 7 cut from the formation 1, which comprises a group 4 of three caps 3, which is produced by cutting formation 1 into pieces at a midpoint along each interval 6. The product 7 is suitable for placement and shrinking on a three wire crimped connection to magnet wires like those described above.

As the formation 1 was cut at a midpoint along each interval 6 to produce product 7, sections 8 and 9 of the strip of material 2 extend out of either side of the product 7. These sections 8 and 9 can serve as tabs for use in automatic or manual manipulation of the product 7. In addition, the sections 8 and 9 can also serve as barbs, or another locating or mounting feature, for use in affixing the product 7 to another item, for example when inserting it into the windings of an electrical motor.

Figure 4:
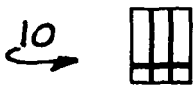
FIG. 4 is a side view of a second product of the electrical insulating cap formation as shown in FIG. 1.

FIG. 4 shows as alternative product 10, which is the same as product 7, but without the sections 8 and 9. This product 10 can be formed by cutting the strip of material 2 of formation 1 at the beginning and end of each group 4 of caps 3. This configuration may be preferred in some circumstances.

It will be appreciated that products 7 and 10 can also be cut from formation 1 by the manufacturer, and shipped in that configuration. Such an arrangement may be preferred when the products Tor 10 are for manual mounting to three wire crimped connections for use in electrical motors, and the customer has no automatic cutting facility.

Figure 5:
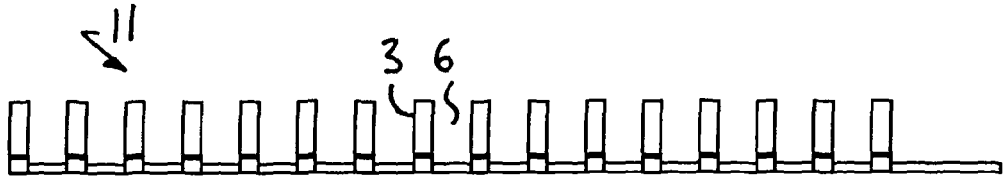
FIG. 5 is a side view of a second electrical insulating cap formation according to the present invention.

FIG. 5 shows a second electrical insulating cap formation 11 which is the same as formation 1 above, except that the strip of material 2 carries individually separated heat shrinkable electrical insulating caps 3. The formation 11 can be used in the same ways as formation 1 described above, but where individual electrical insulating caps 3 are required, as opposed to groups of three. Again, the formation 11 can be shipped in long strips for feeding into automatic cutting and mounting machines, or for manually cutting and mounting, or the formation 11 can be cut up during the initial manufacturing stage and shipped in that configuration.

Figure 6:
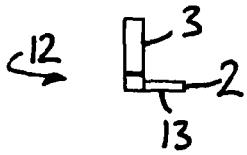
FIG. 6 is a side view of a product of the electrical insulating cap formation as shown in FIG. 5.

FIG. 6 shows a possible product 12 cut from the formation 11, which is produced by cutting formation 11 into pieces at an end point of each interval 6. As such a section 13 of the strip of material 2 extends out of one side of the separated cap 3, which can be used to carry the cap 3 automatically or manually, and it can also serve as a locating feature like a barb or a weld platform.

Figure 7:
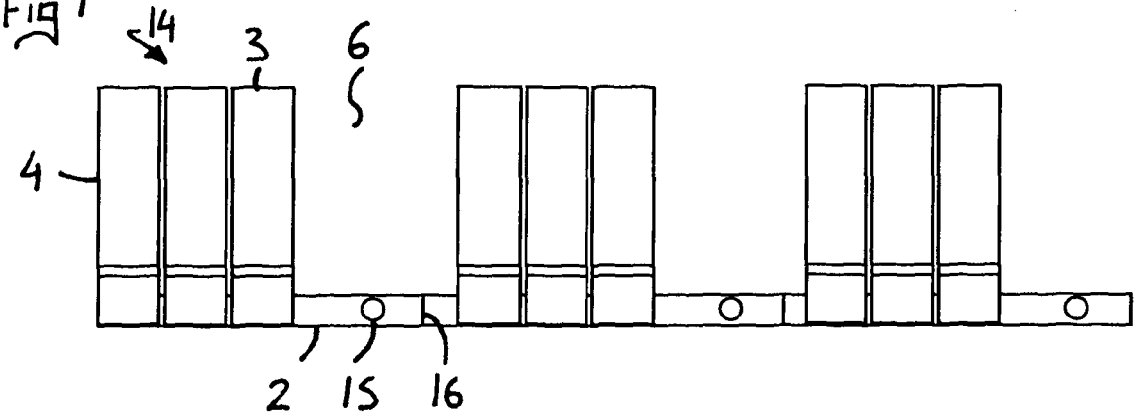
FIG. 7 is a side view of a third electrical insulating cap formation according to the present invention.

FIG. 7 shows a third formation 14, which is the same as formation 1, except that readable position markings 15 are provided on the strip of material 2 at mid points along the intervals 6. The markings 15 comprise a punched hole in the strip of material 2, and they are intended to be used with an automatic optical reading device. The markings 15 can be used by a machine to precisely locate the formation 14, and therefore the groups 4 of caps 3 carried thereon, which may be of use during cutting of the strip of material 2, or later during orientation of separated caps 3 prior to, or during fitment to another item.

In addition, the strip of material 2 is also provided with score lines 16 which allow the strip of material 2 to be more readily cut or broken apart, either automatically or manually.

The markings 15 and score lines 16 are mere examples of the type and positioning of such additional features which may assist in a secondary manufacturing stage.

Figure 8:
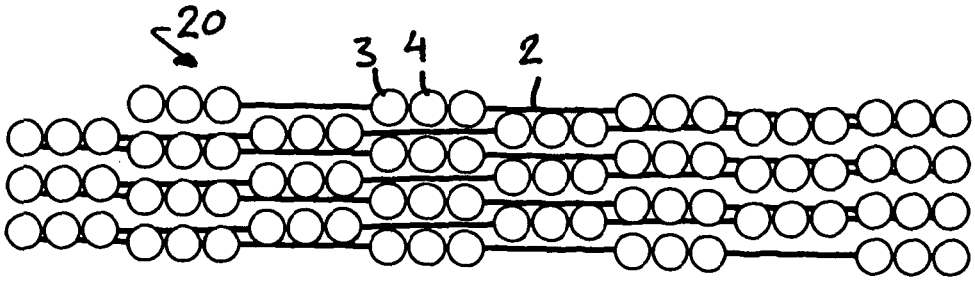
FIG. 8 is a top view of a fourth electrical insulating cap formation according to the present invention.

FIG. 8 shows an fourth formation 20 which is the same as formation 1, except that the formation 20 comprises folds normal to its lengthwise axis, each of which is in the opposite direction to the last. As such, the formation 20 can be folded up neatly in a zigzag arrangement for ready transport or storage.

Figure 9:
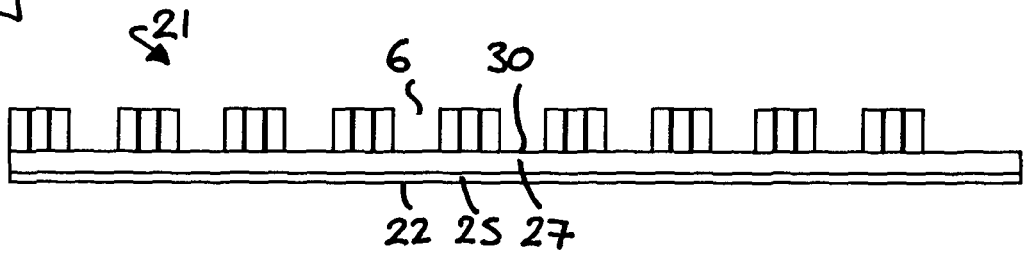
FIG. 9 is a side view of a fifth electrical insulating cap formation according to the present invention.
Figure 10:
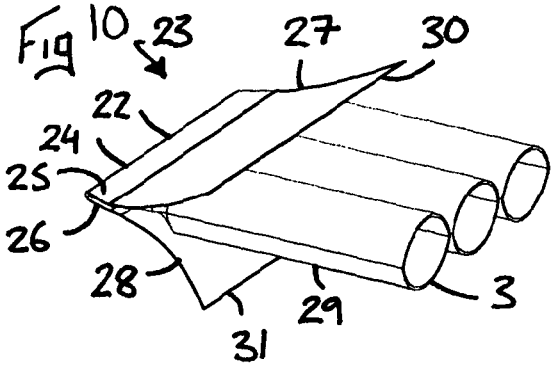
FIG. 10 is a perspective view of a product of the electrical insulating cap formation as shown in FIG. 9.

FIG. 9 shows a fifth formation 21, which is the same as formation 1, except that the strip of material 22 is double sided and provided with advantageous barb features. FIG. 10 shows a product 23 of the formation 21, which is produced by cutting formation 21 into pieces at a mid-point along the interval 6. The construction of the strip of material 21 is best understood by reference to FIG. 10.

The strip of material 22 is folded along a line 24 substantially parallel to its lengthwise axis, and end sections 5 of caps 3 are disposed inside the strip of material 22 with a first section 25 thereof extending over one side of the end sections 5, and a second section 26 extending over the other side of the end sections 5. Therefore, the strip of material 22 does not merely carry the end sections 5 on one side thereof as with the embodiments described above, rather it is folded on itself and envelops the end sections 5 of the caps 3.

As is clear from FIG. 10, the first and second sides 25 and 26 of the strip of material 22 comprise a height which is greater than the lengthwise extent of the end sections 5, and as such first and second wing portions 27 and 28 are provided, which extend over part of tubular sections 29 of the caps 3. The strip of material 22 is formed from a semi-rigid plastics material, and as such outer edges 30 and 31 of the first and second wing portions 27 and 28 are spaced apart from said tubular sections 29. The outer edges 30 and 31 are forced out like this by the shape of the part of the caps 3 which is disposed inside the strip of material 22.

As with the embodiments described above, the weld which closes the end sections 5 is the same weld which fixes the end sections 5 to the strip of material 22. The strip of material 22 is placed over the end sections 5, and an ultrasonic weld is applied to the exterior thereof, which acts to weld all the material together.

As referred to above, product 23 was formed by cutting the interval 6 at a mid point thereof, so sections of the strip of material 22 extend out of either side of the product 21. This is necessary in this case to prevent damage being caused to the caps 3. Cutting of the folded strip of material 22 serves to flatten it, and if this were performed too close to the caps 3, they could also be flattened and therefore damaged. As above, the product 23 can be cut from a formation during the first stage of manufacture, or formations can be shipped to a customer for them to cut them, or to feed them into automatic cutting and/or mounting machines.

The product 23 is intended for use with the three grouped crimped connections to magnet wires in an electric motor. The product 23 can be pushed into the windings of the motor end sections 5 first, during which action the wing portions 27 and 28 will tend to be forced against the caps 3, then once inside the windings the wing portions 27 and 28 can unfurl to an extent and serve to hold the product 23 in position.

Figure 11:
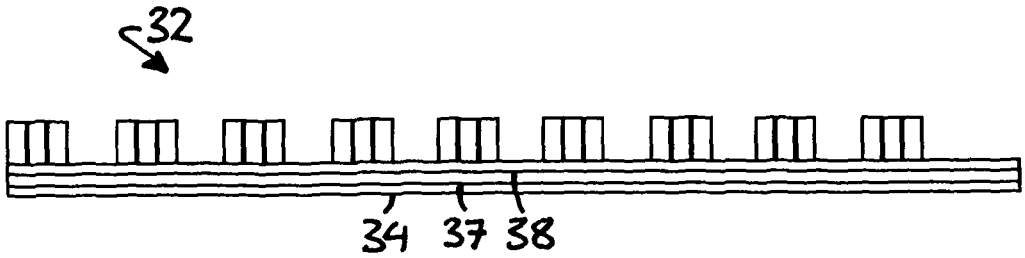
FIG. 11 is side view of a sixth electrical insulating cap formation according to the present invention.
Figure 12:
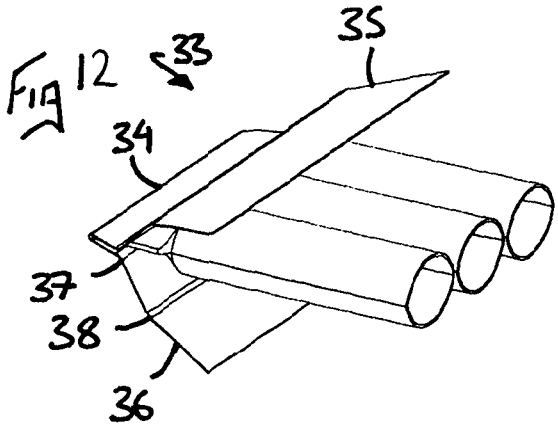
FIG. 12 is a perspective view of a product of the electrical insulating cap formation as shown in FIG. 11.

FIGS. 11 and 12 show formation 32, which is like formation 21, and product 33 which is like product 23, except that the strip of material 34 has a different shape. In particular, rather than abutting against the caps 3, the wing portions 35 and 36 are each provided with two folds 37 and 38 in opposite directions, such that they extend out and over the caps 3.

The above described embodiments can be altered without departing from the scope of claim 1. For example, in alternative embodiments (not shown) the electrical insulating caps are carried on the strip of material at points other than at their closed ends, including at a midpoint thereof, and adjacent their open ends.

In other alternative embodiments (not shown) the electrical insulating caps are arranged at other orientations to the strip of material as required, including at 45 degrees thereto.

In another alternative embodiment (not shown) a formation is provided with a barb feature on one side only. The strip of material comprises a height greater than the lengthwise extent of the end sections of the caps, and the strip of material comprises a wing portion which extends over part of the tubular sections of the caps.

Therefore, the present invention provides a formation of electrical insulating caps which can be fed continuously into an assembly machine, which does away with the need for machinery to handle, orientate and feed separate parts into such an assembly machine. In addition, the present invention also provides a formation of electrical insulating caps which can be cut up to provide products specifically adapted to suit a particular requirement, for example a row of three caps for insulating the three grouped crimped connections to magnet wires used in an electric motor. In addition, the provision of the interval between the caps allows for products to be produced which are provided with manipulation and/or locating tabs or barbs extending from them, which can further enhance their functionality.

The invention claimed is:

1. An electrical insulating cap formation comprising a strip of material and a plurality of electrical insulating caps carried thereon in a row, wherein the electrical insulating caps are formed into separated groups on the strip of material, in which each group comprises two or more of the electrical insulating caps, and in which the groups are separated by intervals between the groups.

2. An electrical insulating cap formation as claimed in claim 1 in which the electrical insulating caps each comprises a tube with a closed end section, in which the closed end section comprises a flattened section of tube welded together, and in which the end sections of the one or more electrical insulating caps are carried on the strip of material.

3. An electrical insulating cap formation as claimed in claim 2 in which the electrical insulating caps each comprise a lengthwise axis, in which the strip of material comprises a lengthwise axis, and in which the electrical insulating caps are carried on the strip of material with their lengthwise axis substantially normal to the lengthwise axis of the strip of material.

4. An electrical insulating cap formation as claimed in claim 3 in which the end sections of the one or more electrical insulating caps are welded to the strip of material.

5. An electrical insulating cap formation as claimed in claim 4 in which the end sections are welded to the strip of material with the same weld which forms the closed end section.

6. An electrical insulating cap formation as claimed in claim 1 in which the electrical insulating caps are heat shrinkable.

7. An electrical insulating cap formation as claimed in claim 1 in which the electrical insulating caps are formed from wound polymeric films.

8. An electrical insulating cap formation as claimed in claim 1 in which the strip of material is provided with readable position markings at pre-determined positions in relation to the electrical insulating caps.

9. An electrical insulating cap formation as claimed in claim 8 in which the readable position markings comprise indicia applied to the strip of material.

10. An electrical insulating cap formation as claimed in claim 8 in which the readable position markings comprise openings formed in the strip of material.

11. An electrical insulating cap formation as claimed in claim 1 in which the strip of material is provided with score lines at pre-determined positions in relation to the electrical insulating caps.

12. An electrical insulating cap formation as claimed in claim 3 in which the strip of material comprises a plurality of folds substantially normal to the lengthwise axis of the strip of material, and in which each fold is in the opposite direction to the last.

13. An electrical insulating cap formation as claimed in claim 3 in which the strip of material comprises a height, in which said height is greater than the lengthwise extent of the end sections, in which the strip of material comprises a wing portion which extends over at least a part of tubular sections of the electrical insulating caps, and in which the strip of material is formed such that an outer edge of said wing portion is spaced apart from said tubular sections of the electrical insulating caps.

14. An electrical insulating cap formation as claimed in claim 13 in which said outer edge of said wing portion is greater in length than an inner edge of the strip of material, such that first and second ends of the strip of material are angled in relation to the lengthwise axes of the one or more electrical insulating caps.

15. An electrical insulating cap formation as claimed in claim 3 in which the strip of material is folded along a line substantially parallel to its lengthwise axis, in which the end sections of the electrical insulating caps are disposed inside the strip of material with a first section of the strip of material extending over a first side of said end sections and a second section of the strip of material extending over a second side of said end sections.

16. An electrical insulating cap formation as claimed in claim 15 in which the first and second sides of the strip of material comprise a height which is greater than the lengthwise extent of the end sections, in which the strip of material comprises first and second wing portions which extend over at least a part of tubular sections of the electrical insulating caps on opposite sides thereof, and in which the strip of material is formed such that outer edges of the first and second wing portions are spaced apart from said tubular sections of the electrical insulating caps on opposite sides thereof.

17. An electrical insulating cap formation as claimed in claim 16 in which said outer edges of the first and second wing portions are greater in length than the folded part of the strip of material, such that first and second ends of the strip of material are angled in relation to the lengthwise axis of the electrical insulating caps.

* * * * *